US008248361B2

(12) United States Patent
Inada et al.

(10) Patent No.: US 8,248,361 B2
(45) Date of Patent: Aug. 21, 2012

(54) DISPLAY CONTROL APPARATUS AND METHOD, AND PROGRAM

(75) Inventors: Tetsuji Inada, Kanagawa (JP); Mitsuyasu Asano, Tokyo (JP); Takeshi Hiramatsu, Tokyo (JP); Koji Nishida, Tokyo (JP)

(73) Assignee: Sony Corporation (JP)

( * ) Notice: Subject to any disclaimer, the term of this patent is extended or adjusted under 35 U.S.C. 154(b) by 310 days.

(21) Appl. No.: 12/452,336

(22) PCT Filed: May 8, 2009

(86) PCT No.: PCT/JP2009/058667

§ 371 (c)(1),
(2), (4) Date: Dec. 22, 2009

(87) PCT Pub. No.: WO2009/136632

PCT Pub. Date: Nov. 12, 2009

(65) Prior Publication Data

US 2010/0134527 A1 Jun. 3, 2010

(30) Foreign Application Priority Data

May 8, 2008 (JP) ..... P2008-122171

(51) Int. Cl.
*G09G 3/36* (2006.01)
*G09G 5/00* (2006.01)

(52) U.S. Cl. ..... 345/102; 345/690

(58) Field of Classification Search ..... 345/87–89, 345/204, 690, 102
See application file for complete search history.

(56) References Cited

U.S. PATENT DOCUMENTS 6,111,559 A * 8/2000 Motomura et al. ..... 345/102
6,795,053 B1 * 9/2004 Funamoto et al. ..... 345/102
6,839,048 B2 1/2005 Park
(Continued)

FOREIGN PATENT DOCUMENTS

JP 10-161629 A 6/1998
JP 2002-202767 A 7/2002
(Continued)

OTHER PUBLICATIONS

Locally Pixel—Compensated Backlight Dimming on LED—Backlit LCD TV, SID Journals, 1475 S. Bascom Ave., Ste. 114, Campbell, CA 95008-4006 USA, Dec. 15, 2007, XP040426644, pp. 981-988.

(Continued)

*Primary Examiner* — Stephen Sherman
(74) *Attorney, Agent, or Firm* — Lerner, David, Littenberg, Krumholz & Mentlik, LLP

(57) ABSTRACT

The present invention relates to a display control apparatus and method, and a program which make it possible to prevent deterioration in image quality due to insufficient luminance of light from a backlight.

A backlight luminance calculating section (121) finds the backlight luminance of light to be radiated by a backlight, on the basis of the image signal of a display image. A moving image determining section (122) determines whether or not the display image is a moving image on the basis of the image signal. A correction value calculating section (123) increases the last correction value by a predetermined value to obtain a new correction value when the display image is a moving image, and decreases the last correction value by a predetermined value to obtain a new correction value when the display image is a still image. An addition section (124) adds the correction value to the backlight luminance to correct the backlight luminance. The present invention can be applied to a liquid crystal display apparatus.

5 Claims, 10 Drawing Sheets

U.S. PATENT DOCUMENTS

| | | | | |
|---|---|---|---|---|
| 7,136,044 | B2 | 11/2006 | Sasaki | |
| 7,199,776 | B2 * | 4/2007 | Ikeda et al. | 345/89 |
| 7,298,358 | B2 * | 11/2007 | Honbo | 345/102 |
| 7,567,245 | B2 | 7/2009 | Mamata | |
| 2002/0118182 | A1 * | 8/2002 | Luther Weindorf | 345/204 |
| 2004/0114396 | A1 * | 6/2004 | Kobayashi et al. | 362/561 |
| 2005/0174320 | A1 | 8/2005 | Park | |
| 2005/0184952 | A1 | 8/2005 | Konno et al. | |
| 2007/0002081 | A1 | 1/2007 | Sakata | |
| 2008/0068359 | A1 | 3/2008 | Yoshida et al. | |
| 2008/0074372 | A1 | 3/2008 | Baba et al. | |

FOREIGN PATENT DOCUMENTS

| | | | |
|---|---|---|---|
| JP | 2004-279503 | A | 10/2004 |
| JP | 2007-322901 | A | 12/2007 |
| JP | 2008-070838 | A | 3/2008 |
| JP | 2008-096521 | A | 4/2008 |
| WO | WO-03-075257 | A1 | 9/2003 |

OTHER PUBLICATIONS

European Search Report EP 09742756, dated Jan. 16, 2012.

* cited by examiner

DISPLAY CONTROL APPARATUS AND METHOD, AND PROGRAM

CROSS-REFERENCES TO RELATED APPLICATIONS

The present application is a national phase entry under 35 U.S.C. §371 of International Application No. PCT/JP2009/058667 filed May 8, 2009, published on Nov. 12, 2009 as WO 2009/136632 A1, which claims priority from Japanese Patent Application No. JP 2008-122171 filed in the Japanese Patent Office on May 8, 2008.

TECHNICAL FIELD

The present invention relates to a display control apparatus and method, and a program, in particular, a display control apparatus and method, and a program which are suitable for use in cases where an image is displayed on a liquid crystal panel by using a plurality of backlights.

BACKGROUND ART

In the related art, as a liquid crystal display apparatus using a transmission type liquid crystal panel, there has been proposed one which uses a plurality of backlights to vary the quantity of incident light for each display region on the liquid crystal panel, thereby achieving an increase in the dynamic range of the luminance of a displayed image (see, for example, Patent Document 1). That is, according to this liquid crystal display apparatus, the contrast of the displayed image can be enhanced.

PRIOR ART DOCUMENTS

Patent Documents

Patent Document 1: Japanese Unexamined Patent Application Publication No. 2007-322901

DISCLOSURE OF INVENTION

Technical Problem

Incidentally, in the case where each of a plurality of backlights makes light incident on each corresponding display region on the liquid crystal panel in this way, as shown in FIG. 1, the light quantity to be emitted by each backlight can be found from the image signal of an image to be displayed.

That is, in FIG. 1, an image signal having the stepped waveform indicated by arrow A11 is inputted to a light emission quantity calculating section 11 and a division section 12. In the light emission quantity calculating section 11, the light quantity to be emitted by each single backlight is calculated on the basis of the image signal.

Here, since the size of each single backlight is larger than the size of pixels in the display region of the liquid crystal panel, the light quantity from the backlight is calculated from the pixel value, more specifically, the luminance value, of each pixel of an image displayed in the display region of the liquid crystal panel corresponding to the backlight. Also, as indicated by arrow A12, light from the backlight is made incident uniformly on each position of the display region of the liquid crystal panel.

It should be noted that in the waveforms indicated by arrow A11 to arrow A13 in FIG. 1, the horizontal direction indicates an image based on an image signal, or the position of a pixel in the display region of the liquid crystal panel which displays the image, and the vertical direction indicates luminance.

Also, in the division section 12, the supplied image signal is divided by the light quantity from the light emission quantity calculating section 11, thereby calculating the transmittance of light in the display region of the liquid crystal panel corresponding to the backlight.

Then, once the light quantity and the transmittance are calculated, the backlight emits light on the basis of the light quantity calculated by the light emission quantity calculating section 11, and makes the light incident on the liquid crystal panel. Also, the liquid crystal panel transmits light from the backlight at the transmittance calculated by the division section 12. Thus, substantially the same image as the image of an inputted image signal is displayed in the display region of the liquid crystal panel.

However, there are cases in which when the backlight emits light at the light quantity calculated by the light emission quantity calculating section 11, the luminance of light incident on the liquid crystal panel from the backlight is lower than the luminance necessary for displaying an image based on the inputted image signal.

That is, when the light quantity (luminance) of light indicated by arrow A12 is insufficient for displaying a predetermined region of the image indicated by arrow A11, the transmittance of each pixel in the display region of the liquid crystal panel which is found by the division section 12 exceeds 100% as indicated by arrow A13. In FIG. 1, the portion indicated by a dotted line of the transmittance of each pixel in the display region indicated by arrow A13 indicates a portion where the transmittance exceeds 100%.

For example, it is known that since the backlight and the liquid crystal panel differ in response speed during operation, and changing of the light quantity of light from the backlight and changing of the transmittance of the liquid crystal panel are not synchronized with each other, the image quality of an image deteriorates when the light quantity of light from the backlight changes abruptly. In particular, there are cases in which when the image to be displayed is a moving image, the light quantity of light from the backlight changes abruptly, and the image quality of the image noticeably deteriorates.

Accordingly, to suppress such deterioration in image quality, it is conceivable to apply cyclic processing to the light quantity calculated in the light emission quantity calculating section 11. In such a case, the light emission quantity calculating section 11 performs cyclic processing so as to calculate the final light quantity of a frame to be displayed from now on, on the basis of the light quantity of the frame of an image to be displayed from now on, and the light quantity of a frame immediately preceding the frame, thereby suppressing an abrupt change in light quantity.

However, since an abrupt change in light quantity is suppressed when cyclic processing is applied to the light quantity, there are cases when the final light quantity found by the cyclic processing, that is, the luminance of light from the backlight is lower than the luminance necessary for displaying the image to be displayed from now on.

When the light quantity of light from the backlight becomes insufficient as described above, in a part of the region on the image displayed on the liquid crystal panel, changes in luminance are lost and the image deteriorates in image quality. That is, since pixels in a liquid crystal panel cannot transmit light at a transmittance exceeding 100%, the luminances of images displayed by pixels whose calculated transmittances exceed 100% all become the same value.

As described above, in the case of displaying an image on a liquid crystal panel by using a backlight, there are cases where, depending on the inputted image signal, the light quantity of light radiated from the backlight is not controlled appropriately, and the image quality of a displayed image deteriorates.

The present invention has been made in view of the above circumstances, and makes it possible to suppress deterioration in image quality due to insufficient light quantity of light from the backlight.

Technical Solution

A display control apparatus according to an aspect of the present invention includes: luminance calculating means for calculating a backlight luminance on the basis of an image signal of a display image, the backlight luminance indicating a luminance of light which is made incident on a display panel that displays the display image by transmitting light, and which is radiated by a backlight; correction value changing means for increasing a correction value for correcting the backlight luminance of a previous display image, which is the display image displayed temporally before a not-yet-displayed image that is the display image to be displayed from now on, to obtain the correction value for the not-yet-displayed image when the not-yet-displayed image is a moving image, and decreasing the correction value for the previous display image to obtain the correction value for the not-yet-displayed image when the not-yet-displayed image is a still image; and correcting means for correcting the backlight luminance by adding the correction value changed by the correction value changing means, to the backlight luminance of the not-yet-displayed image.

The display control apparatus can be further provided with limiting means for setting an upper limit value of the correction value for the not-yet-displayed image when the not-yet-displayed image is a moving image, and setting the upper limit value as the correction value for the not-yet-displayed image when the correction value is larger than the upper limit value.

The display control apparatus can be further provided with motion detecting means for detecting motion from the not-yet-displayed image on the basis of the image signal, and the limiting means can be configured to set the upper limit value according to a motion amount of the motion detected from the not-yet-displayed image.

The limiting means can be configured to set a lower limit value of the correction value for the not-yet-displayed image when the not-yet-displayed image is a still image, and set the lower limit value as the correction value for the not-yet-displayed image when the correction value is smaller than the lower limit value.

The limiting means can be configured to cancel setting of the upper limit value and set the lower limit value, when the display image is a moving image and the correction value for the previous display image is larger than the upper limit value for the not-yet-displayed image, and the correction value changing means can be configured to decrease the correction value for the previous display image to obtain the correction value for the not-yet-displayed image.

A display control method or a program according to an aspect of the present invention includes the steps of: calculating a backlight luminance on the basis of an image signal of a display image, the backlight luminance indicating a luminance of light which is made incident on a display panel that displays the display image by transmitting light, and which is radiated by a backlight; increasing a correction value for correcting the backlight luminance of a previous display image, which is the display image displayed temporally before a not-yet-displayed image that is the display image to be displayed from now on, to obtain the correction value for the not-yet-displayed image when the not-yet-displayed image is a moving image, and decreasing the correction value for the previous display image to obtain the correction value for the not-yet-displayed image when the not-yet-displayed image is a still image; and correcting the backlight luminance by adding the correction value that has been changed, to the backlight luminance of the not-yet-displayed image.

According to an aspect of the present invention, a backlight luminance is calculated on the basis of an image signal of a display image, the backlight luminance indicating a luminance of light which is made incident on a display panel that displays the display image by transmitting light, and which is radiated by a backlight. A correction value for correcting the backlight luminance of a previous display image, which is the display image displayed temporally before a not-yet-displayed image that is the display image to be displayed from now on, is increased to obtain the correction value for the not-yet-displayed image when the not-yet-displayed image is a moving image, and the correction value for the previous display image is decreased to obtain the correction value for the not-yet-displayed image when the not-yet-displayed image is a still image. The backlight luminance is corrected by adding the correction value that has been changed, to the backlight luminance of the not-yet-displayed image.

Advantageous Effects

According to an aspect of the present invention, an image can be displayed. In particular, according to an aspect of the present invention, deterioration in image quality due to insufficient light quantity of light from the backlight can be suppressed.

BEST MODE FOR CARRYING OUT THE INVENTION

Hereinbelow, an embodiment to which the present invention is applied will be described with reference to the drawings.

Figure 1:
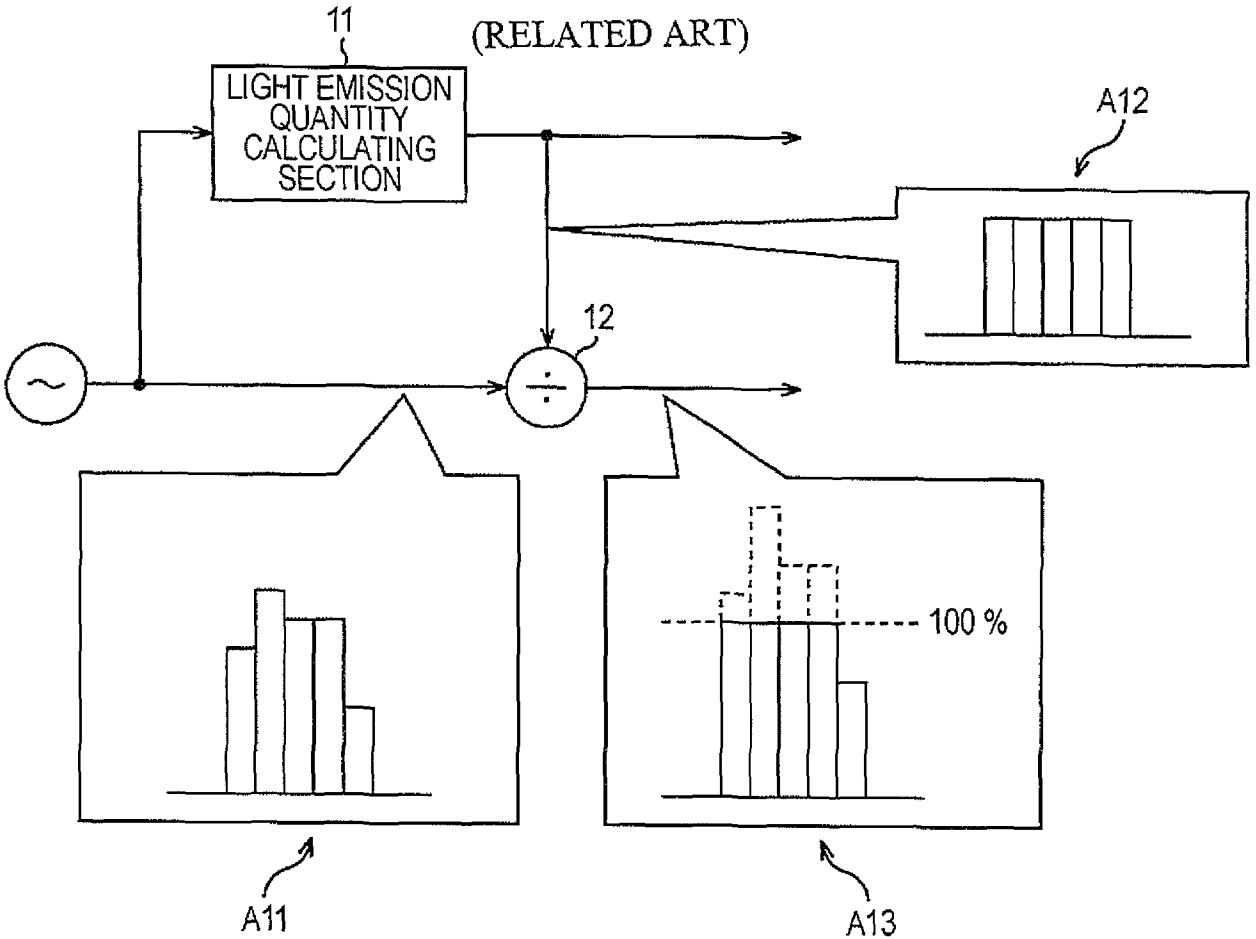
FIG. 1 (RELATED ART)
FIG. 1 is a diagram showing the configuration of a liquid crystal display apparatus according to the related art.
Figure 2:
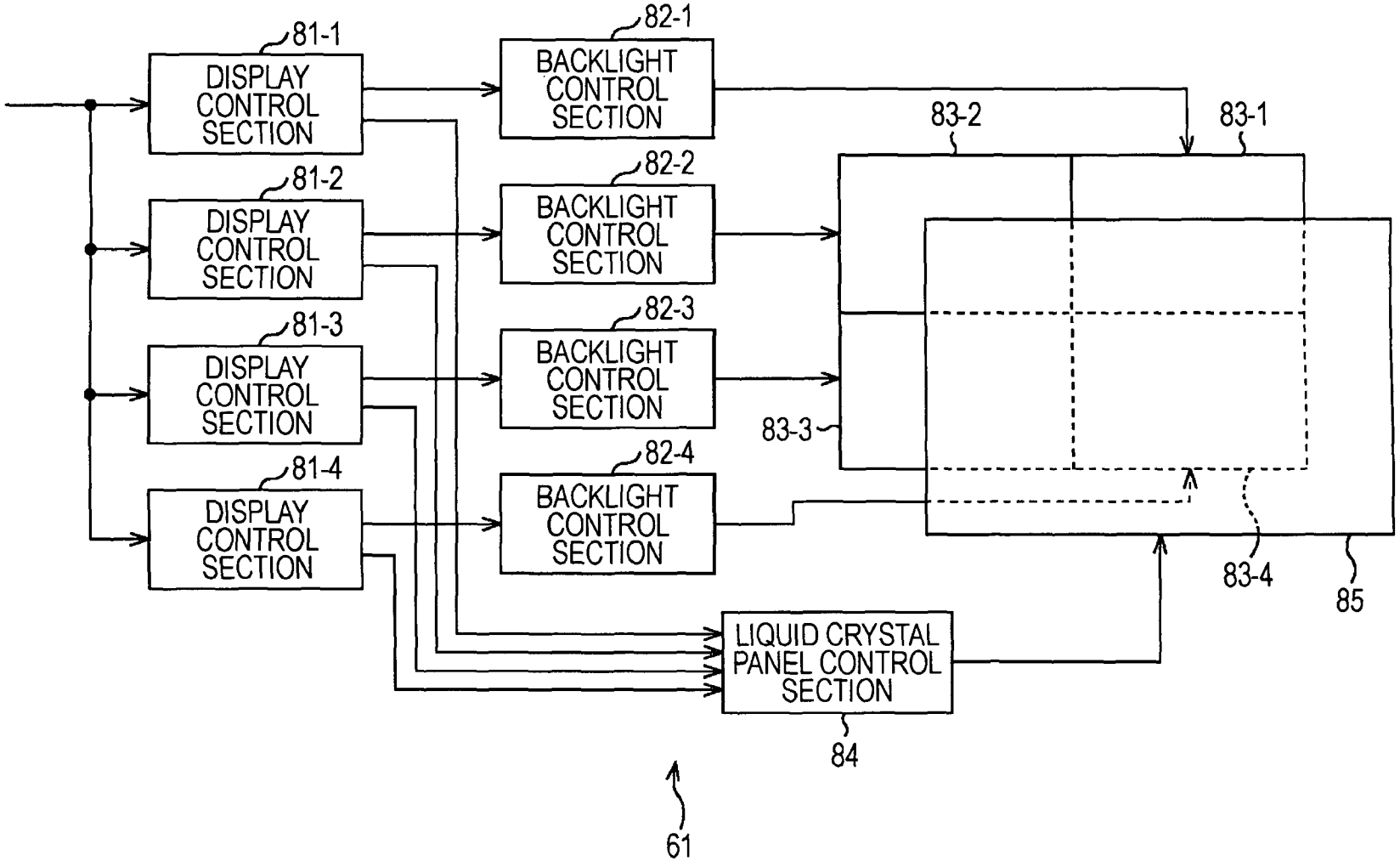
FIG. 2 is a diagram showing a configuration example of an embodiment of a display apparatus to which the present invention is applied.

FIG. 2 is a diagram showing a configuration example of an embodiment of a display apparatus to which the present invention is applied.

A display apparatus 61 includes display control section 81-1 to display control section 81-4, backlight control section 82-1 to backlight control section 82-4, backlight 83-1 to backlight 83-4, a liquid crystal panel control section 84, and a liquid crystal panel 85.

The display apparatus 61 is, for example, a liquid crystal display apparatus such as a liquid crystal display. An image signal of a display image to be displayed on the liquid crystal panel 85 is inputted to the display control section 81-1 to display control section 81-4 of the display apparatus 61.

On the basis of the inputted image signal, the display control section 81-1 to the display control section 81-4 calculate the light quantity of light to be radiated from the backlight 83-1 to the backlight 83-4, more specifically, a backlight luminance indicating the luminance of light, and supplies the backlight luminance to the backlight control section 82-1 to the backlight control section 82-4.

Also, on the basis of the image signal, with respect to each of display regions of the liquid crystal panel 85 on which much of light from each of the backlight 83-1 to the backlight 83-4 is incident, the display control section 81-1 to the display control section 81-4 calculate the transmittance of each pixel within the display region and supplies the transmittance to the liquid crystal panel control section 84. This transmittance takes a value between 0 and 1, for example.

It should be noted that a pixel in the display region of the liquid crystal panel 85 refers to a single cell that serves as a unit of image display, and is made up of each region that transmits each light of R, G, and B.

On the basis of the backlight luminance supplied from the display control section 81-1 to the display control section 81-4, the backlight control section 82-1 to the backlight control section 82-4 control the backlight 83-1 to the backlight 83-4 so as to emit light. Also, in accordance with the control of the backlight control section 82-1 to the backlight control section 82-4, the backlight 83-1 to the backlight 83-4 emit light, and makes the light incident on the liquid crystal panel 85.

The liquid crystal panel control section 84 causes the liquid crystal panel 85 to transmit light at the transmittance of each pixel, that is, aperture ratio, supplied from the display control section 81-1 to the display control section 81-4. The liquid crystal panel 85 transmits light incident on each pixel in the display region from the backlight 83-1 to the backlight 83-4, at the transmittance instructed from the liquid crystal panel control section 84, thereby displaying a display image.

It should be noted that hereinafter, each of the display control section 81-1 to the display control section 81-4 will be simply referred to as display control section 81 in cases where there is no need to individually differentiate between them, and each of the backlight control section 82-1 to the backlight control section 82-4 will be simply referred to as backlight control section 82 in cases where there is no need to individually differentiate between them. Also, hereinafter, each of the backlight 83-1 to the backlight 83-4 will be simply referred to as backlight 83 in cases where there is no need to individually differentiate between them.

In the display apparatus 61, the backlight 83 as a light source is placed on the back surface of the liquid crystal panel 85, and much of the light radiated from the backlight 83 is incident on the display region of the liquid crystal panel 85 opposed to the backlight 83. For example, much of the light radiating from the backlight 83-1 is incident on the portion of the liquid crystal panel 85 located diagonally above to the right in the drawing. Therefore, in the case of displaying an image such that the side of the liquid crystal panel 85 located diagonally above to the right is bright, and the other portion is dark, only the backlight 83-1 can be made to emit light at somewhat high luminance, and the other backlight 83-2 to backlight 83-4 can be made to emit light at relatively low luminance. This makes it possible to suppress consumption of power by the backlight 83. Also, the dynamic range of the luminance of a display image can be increased, and the contrast of the display image can be enhanced.

It should be noted that while the display apparatus 61 is provided with the transmission type liquid crystal panel 85, not only a liquid crystal panel but any kind of transmission type display panel that displays an image by transmitting light from the backlight 83 may be used.

Figure 3:
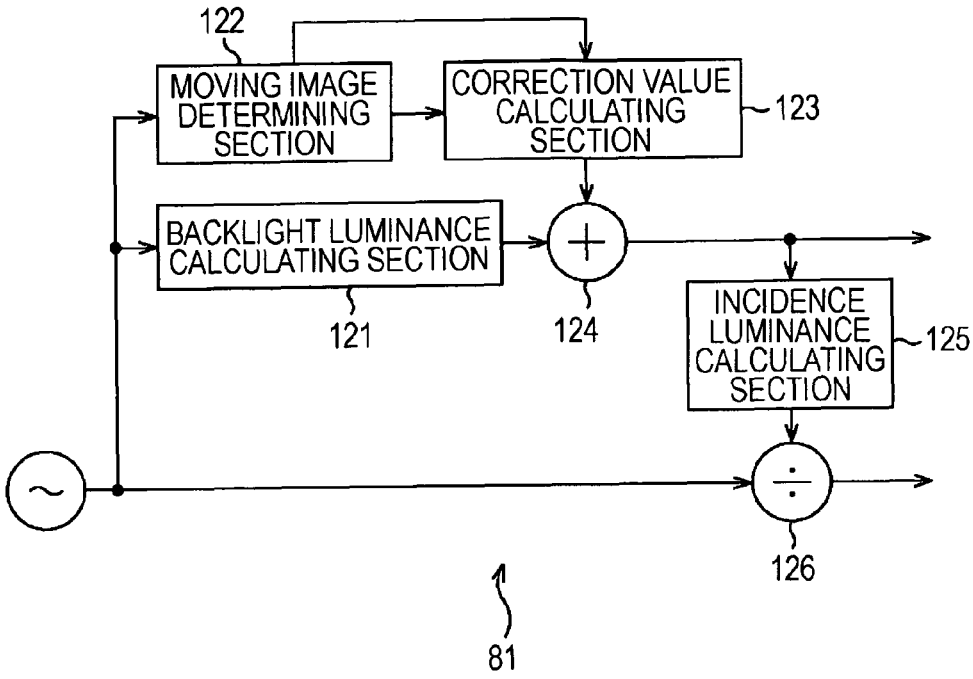
FIG. 3 is a diagram showing a more detailed configuration example of a display control section.

Next, FIG. 3 is a diagram showing a more detailed configuration example of the display control section 81 in FIG. 2.

The display control section 81 includes a backlight luminance calculating section 121, a moving image determining section 122, a correction value calculating section 123, an addition section 124, an incidence luminance calculating section 125, and a division section 126.

An image signal inputted to the display control section 81 of the display apparatus 61 is supplied to the backlight luminance calculating section 121, the moving image determining section 122, and the division section 126 of the display control section 81. This image signal is, for example, the image signal of a moving image or still image.

The backlight luminance calculating section 121 calculates the backlight luminance of light to be radiated by the backlight 83, on the basis of the supplied image signal, and supplies the backlight luminance to the addition section 124.

For example, on the basis of an image signal, the backlight luminance calculating section 121 finds the maximum value of luminances of pixels in a region on a display image based on the image signal which is a region displayed in the display region of the liquid crystal panel 85 corresponding to the backlight 83. Then, on the basis of the maximum value found, the backlight luminance calculating section 121 finds the backlight luminance of light to be radiated by the backlight 83.

It should be noted that the display region of the liquid crystal panel 85 corresponding to the backlight 83 refers to a region which is obtained by virtually splitting the entire display region of the liquid crystal panel 85 and on which the majority of light from each single backlight 83 directly below the back surface of the liquid crystal panel 85 is incident.

For example, supposing that the display region of the liquid crystal panel 85 is virtually split in four, into upper right, upper left, lower left, and lower right regions in FIG. 2, display regions respectively corresponding to the backlight 83-1 to the backlight 83-4 are the upper right, upper left, lower left, and lower right regions on the display region. Hereinafter, a display region of the liquid crystal panel 85 corresponding to the backlight 83 will be also referred to as partial display region.

The moving image determining section 122 performs a moving image determining process on the basis of a supplied image signal, and determines whether or not the display image based on the supplied image signal is a moving image. For example, the moving image determining section 122 performs motion detection by using a display image to be displayed from now on, and a display image displayed on the liquid crystal panel 85 immediately before the display image, thereby identifying whether or not the display image of the supplied image signal is a moving image, or is a still image.

The moving image determining section 122 supplies image information indicating the result of determination by the moving image determining process, and motion information indicating the motion amount of the detected motion, to the correction value calculating section 123.

It should be noted that since display images are displayed in succession in the display apparatus 61, there are cases when, for example, after a moving image is displayed as a display image, a plurality of still images are sequentially displayed. In the following description, each of display images displayed in succession in the display apparatus 61 will be referred to as one frame, that is, one frame of image.

On the basis of the image information and the motion information supplied from the moving image determining section 122, the correction value calculating section 123 calculates a correction value for correcting the backlight luminance, and supplies the correction value to the addition section 124. The addition section 124 adds the correction value from the correction value calculating section 123 to the backlight luminance from the backlight luminance calculating section 121, thereby correcting the backlight luminance. Also, the addition section 124 supplies the corrected backlight luminance to the backlight control section 82 and the incidence luminance calculating section 125.

On the basis of the backlight luminance supplied from the addition section 124, the incidence luminance calculating section 125 calculates a pixel incidence luminance indicating the luminance of light estimated to be incident on a pixel from the backlight 83, with respect to each pixel in the partial display region of the liquid crystal panel 85 corresponding to the backlight 83. That is, a pixel incidence luminance represents information indicating the luminance of light estimated to be incident on a pixel in the partial display region from the backlight 83, in the case when the backlight 83 emits light at the supplied backlight luminance.

For example, the incidence luminance calculating section 125 holds in advance a profile indicating how light radiated from the backlight 83 is diffused when the backlight 83 emits light.

Then, by using the held profile, the incidence luminance calculating section 125 finds the luminances of light estimated to be incident from the backlight 83 on individual pixels in the partial display region of the liquid crystal panel 85 corresponding to the backlight 85, when the backlight 83 emits light at the backlight luminance supplied from the addition section 124, and sets those pixel-by-pixel luminances as pixel incidence luminances.

Upon finding the pixel incidence luminances at individual pixels in the partial display region, the incidence luminance calculating section 125 supplies those pixel incidence luminances to the division section 126.

The division section 126 divides the signal value of a supplied image signal, more specifically a luminance found from the signal value (pixel value of a display image), by the pixel incidence luminances from the incidence luminance calculating section 125, thereby calculating the transmittances of individual pixels in the partial display region. Then, the division section 126 supplies the calculated pixel-by-pixel transmittances to the liquid crystal panel control section 84.

For example, let a targeted pixel in a partial display region be referred to as target pixel. Also, let the pixel incidence luminance of the target pixel be CL, the backlight luminance of the backlight 83 be BL, and the luminance of a pixel on a display image located at the same position as the target pixel, that is, a pixel on a display image in which an image displayed by the target pixel is displayed, be IL. Further, let the transmittance of light at the target pixel be T.

In this case, when the backlight 83 is made to emit light at backlight luminance BL, the luminance of light incident on the target pixel from the backlight 83, that is, the pixel incidence luminance of the target pixel is CL. Then, when the target pixel transmits, at transmittance T, the light of pixel incidence luminance CL incident from the backlight 83, the luminance of light radiated from the target pixel, that is, the luminance of the target pixel as perceived by the user looking at the liquid crystal panel 85 (hereinafter, also referred to as display luminance OL) is represented by pixel incidence luminance CL×transmittance T. If display luminance OL is equal to luminance IL of a pixel in a display image, the same image as the display image is displayed on the liquid crystal panel 85. Hence, supposing that display luminance OL and luminance IL are equal, Equation (1) below holds.

$$\text{Transmittance } T = (\text{luminance IL of a pixel in a display image})/(\text{pixel incidence luminance CL}) \quad (1)$$

Therefore, the division section 126 can calculate appropriate transmittance T of the target pixel by dividing the signal value of an image signal representing the pixel value of a pixel in a display image corresponding to the target pixel, more specifically, luminance IL of the pixel in the display image, by pixel incidence luminance CL of the target pixel supplied from the incidence luminance calculating section 125.

Figure 4:
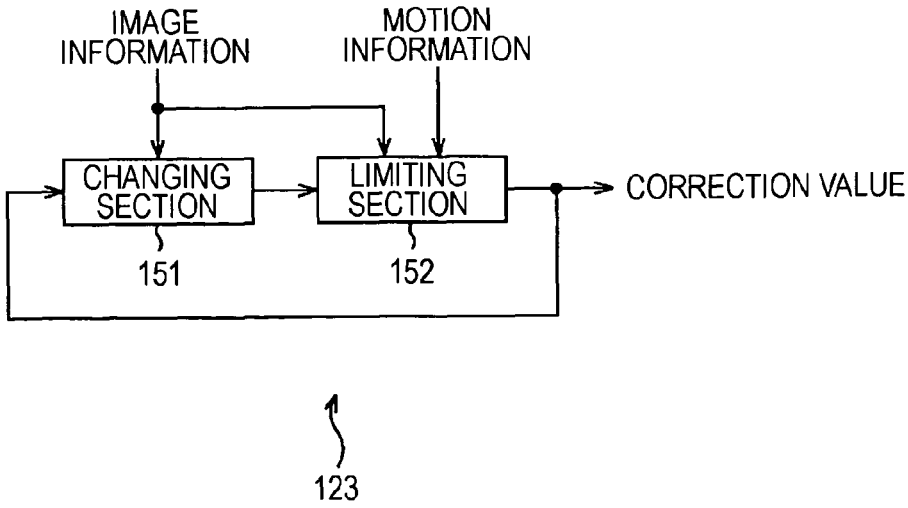
FIG. 4 is a diagram showing a more detailed configuration example of a correction value calculating section.

Next, FIG. 4 is a block diagram showing a more detailed configuration example of the correction value calculating section 123 in FIG. 3.

The correction value calculating section 123 includes a changing section 151 and a limiting section 152.

A correction value for the display image of a frame that temporally immediately precedes a display image to be displayed from now on, is supplied to the changing section 151 from the limiting section 152, and image information is supplied to the changing section 151 from the moving image determining section 122. The changing section 151 changes the correction value from the limiting section 152 on the basis of the supplied image information, and supplies the changed correction value to the limiting section 152.

Image information and motion information are supplied to the limiting section 152 from the moving image determining section 122. On the basis of the supplied image information and motion information, the limiting section 152 sets a limiting value that serves as the upper limit or lower limit when limiting the correction value.

Specifically, when image information indicating that the display image to be displayed from now on is a moving image is supplied, the limiting section 152 sets an upper limit value of the correction value as a limiting value, in accordance with the motion amount indicated by the supplied motion information. Also, when image information indicating that the display image to be displayed from now on is a still image is supplied, the limiting section 152 sets a lower limit value of the correction value as a limiting value.

The limiting section 152 limits the correction value from the changing section 151 by the limiting value that has been set, thereby obtaining the final correction value. Also, the limiting section 152 supplies the final correction value to the changing section 151 and the addition section 124.

Incidentally, when the image signal of a display image is supplied to the display apparatus 61, and displaying of the display image is instructed, in response to the instruction, the display apparatus 61 starts a display process of displaying the display image. Hereinafter, the display process by the display apparatus 61 will be described with reference to the flowchart in FIG. 5.

In step S11, the backlight luminance calculating section 121 calculates the backlight luminance of the backlight 83 on the basis of an inputted image signal. Also, the backlight luminance calculating section 121 performs cyclic processing to correct the calculated backlight luminance, and supplies the corrected backlight luminance to the addition section 124.

That is, the backlight luminance calculating section 121 subtracts the backlight luminance of a frame to be displayed, from the backlight luminance of the temporally immediately preceding frame to find a difference in backlight luminance, and multiples the difference by a cyclic coefficient that is set in advance. Then, the backlight luminance calculating section 121 adds the difference multiplied by the cyclic coefficient, to the backlight luminance of the frame to be displayed, thereby correcting the backlight luminance.

By applying cyclic processing to the backlight luminance in this way, the backlight luminance does not change abruptly even when the luminance of a display image changes abruptly. That is, the backlight luminance changes gradually at a rate according to the cyclic coefficient. Thus, abrupt switching of displays can be mitigated, and deterioration in the image quality of an image which occurs due to an abrupt change in backlight luminance can be suppressed.

In step S12, the display control section 81 performs a backlight luminance correcting process to correct the backlight luminance calculated by the backlight luminance calculating section 121. The backlight luminance corrected by the backlight luminance correcting process is supplied to the backlight control section 82 and the incidence luminance calculating section 125 from the addition section 124. It should be noted that details of the backlight luminance correcting process will be described later.

In step S13, on the basis of the backlight luminance supplied from the addition section 124, the incidence luminance calculating section 125 calculates a pixel incidence luminance for each of pixels in the partial display region of the liquid crystal panel 85 corresponding to the backlight 83. The incidence luminance calculating section 125 supplies the calculated pixel incidence luminance to the division section 126.

In step S14, the division section 126 divides a supplied image signal by the pixel incidence luminance supplied from the incidence luminance calculating section 125, thereby finding the transmittance of a pixel for each of pixels in the partial display region, and supplies the transmittance to the liquid crystal panel control section 84.

In step S15, on the basis of the backlight luminance supplied from the addition section 124, the backlight control section 82 causes the backlight 83 to emit light at the backlight luminance. Also, the backlight 83 emits light on the basis of control of the backlight control section 82, and makes light having the specified backlight luminance incident on the liquid crystal panel 85.

It should be noted that the processes in step S11 to step S14 described above are individually performed by each of the display control section 81-1 to the display control section 81-4. Also, the process in step S15 is performed individually by each of the backlight control section 82-1 to the backlight control section 82-4, and each of the backlight 83-1 to the backlight 83-4.

In step S16, the liquid crystal panel control section 84 controls the operation of the liquid crystal panel 85, on the basis of the transmittance for each pixel in the display region of the liquid crystal panel 85 which is supplied from the display control section 81, and changes the transmittance of each pixel.

In step S17, on the basis of control of the liquid crystal panel control section 84, the liquid crystal panel 85 changes the transmittance of each pixel in the display region to the transmittance specified on a pixel-by-pixel basis, and transmits light incident from the backlight 83, thereby displaying a display image.

In step S18, the display apparatus 61 determines whether or not to end the display of the display image. For example, it is determined to end the display of the display image if ending of the display of the display image has been instructed by the user.

If it is determined in step S18 not to end the display of the display image, the processing returns to step S11, and the above-described processes are repeated. That is, the backlight luminance and the transmittance are found with respect to a display image of the next frame, and the display image is displayed.

In contrast, if it is determined in step S18 to end the display of the display image, each section of the display apparatus 61 ends a process being performed, and the display process ends.

In this way, when an image signal is supplied, the display apparatus 61 finds the backlight luminance and the transmittance and displays a display image.

According to the display apparatus 61, a correction value is found by the correction value calculating section 123, and a backlight luminance is corrected by the found correction value. By adding the correction value as a margin to the backlight luminance in this way, insufficiency of backlight luminance can be suppressed even when the luminance of a display image changes abruptly. As a result, deterioration in the image quality of the display image which occurs due to insufficient luminance can be prevented.

Next, referring to the flowchart in FIG. 6, a description will be given of a backlight luminance correcting process corresponding to the process in step S12 in FIG. 5.

In step S41, the moving image determining section 122 performs a moving image determining process on the basis of an inputted image signal. For example, the moving image determining section 122 detects the motion vector of a display image by block matching, the gradient method, or the like, on the basis of the display image of a frame to be displayed from now on, and the display image of a frame that temporally immediately precedes the frame. That is, the motion of an object on the display image is detected.

Then, on the basis of the result of motion detection from the display image, the moving image determining section 122 generates motion information indicating the motion amount of the detected motion, and also determines whether or not the display image is a moving image and generates image information indicating the determination result. For example, when the motion amount of a motion detected from a display image is equal to or less than a predetermined threshold, it is determined that the display image is a still image, that is, not a moving image.

The moving image determining section 122 supplies the generated image information to the changing section 151 and the limiting section 152, and also supplies the generated motion information to the limiting section 152.

It should be noted that in the moving image determining process by the moving image determining section 122, the determination of whether or not a display image is a moving image may be made on the basis of a change in the difference in brightness (luminance) between the display images of two successive frames.

In step S42, the limiting section 152 sets a limiting value of the correction value on the basis of the image information and the motion information from the moving image determining section 122.

That is, when image information indicating that the display image to be displayed from now on is a still image is supplied, the limiting section 152 sets a lower limit value of the correction value as a limiting value. For example, in the case where 0 is set as a lower limit value, and the correction value is limited by this lower limit value, when the correction value is less than 0, the lower limit value "0" of the correction value is outputted as the limited correction value.

Also, when image information indicating that the display image to be displayed from now on is a moving image is supplied, the limiting section 152 sets an upper limit value of the correction value as a limiting value, in accordance with the motion amount indicated by the supplied motion information.

Specifically, if the motion amount indicated by the motion information is equal to or less than threshold MV that is set in advance, upper limit value UL1 is set as a limiting value, and if the motion amount indicated by the motion information is larger than threshold MV, upper limit value UL2 larger than upper limit value UL1 is set as a limiting value. That is, an upper limit value is set in accordance with the size of a change in display image with respect to the direction of time.

For example, in the case where upper limit value UL1 is set, and a correction value is limited by this upper limit value UL1, when the correction value is equal to or more than upper limit value UL1, the upper limit value "UL1" of the correction value is outputted as a limiting value.

Here, the reason why the upper limit value is set to the larger upper limit value UL2 in the case when a motion amount indicated by motion information is larger than threshold MV is that as the absolute value of the motion vector of a display image becomes larger, the display image changes more largely, and thus there is a high possibility that the backlight luminance will change largely. That is, by making the upper limit value larger, it is possible to prevent insufficiency of the light quantity of light from the backlight 83 which arises due to the correction value being limited by the upper limit value.

In step S43, the changing section 151 determines whether or not a predetermined time period that is set in advance has elapsed since a time that serves as a reference.

The changing section 151 changes the correction value at a predetermined time interval that is set in advance, in order to suppress an abrupt change in backlight luminance. For example, the changing section 151 counts the number of times display of a display image displayed on the liquid crystal panel 85 has switched, that is, the number of frames of the display image that is displayed, and updates the correction value every three frames as a predetermined time interval.

In such a case, the changing section 151 holds a counter indicating the number of frames of a display image that is displayed, and when display of the display image is started, increments the value of the counter every time the display image is displayed. Then, when three frames' worth of display image is displayed, and the value of the counter becomes "3", the changing section 151 determines that a predetermined time period that is set in advance has elapsed, and resets the value of the counter to "0" and counts the number of frames again. In this case, the time at which the value of the counter is reset to "0" is the time that serves as a reference when determining whether or not a predetermined time period has elapsed.

If it is determined in step S43 that a predetermined time period has not elapsed, that is, if the timing for updating the correction value has not been reached, the processing proceeds to step S48.

On the other hand, if it is determined in step S43 that a predetermined time period has elapsed, that is, if the timing for updating the correction value has been reached, the processing proceeds to step S44.

In step S44, on the basis of image information, the changing section 151 determines whether or not a moving image as a display image is to be displayed continuously from a time that serves as a reference.

For example, if image information indicative of a moving image is supplied from the moving image determining section 122, and a moving image has been displayed as a display image in three frames immediately preceding a frame to be displayed from now on, in step S44, it is determined that a moving image is to be displayed continuously. Here, whether or not a moving image has been displayed in the three immediately preceding frames is determined on the basis of, for example, image information that has been supplied up to this time.

If it is determined in step S44 that a moving image is to be displayed continuously, in step S45, the changing section 151 increases the correction value supplied from the limiting section 152 by a value set in advance, thereby changing the correction value. Then, the changing section 151 supplies the changed correction value to the limiting section 152, and thereafter the processing proceeds to step S49.

That is, in the case when a moving image is displayed continuously as a display image, if cyclic processing is applied to the backlight luminance, there is a fear that the change in backlight luminance cannot keep up when the luminance of light to be radiated by the backlight 83 increases abruptly due to a scene change or the like of the moving image, resulting in insufficient backlight luminance.

Accordingly, in the case when a moving image is displayed as a display image continuously for a predetermined time period, the changing section 151 increases the correction value added to the backlight luminance to thereby prevent deterioration in the image quality of the display image which occurs due to insufficient luminance of light from the backlight 83. That is, as a moving image is continuously displayed as a display image, the correction value gradually increases.

Also, if it is determined in step S44 that a moving image is not to be displayed continuously, in step S46, the changing section 151 determines whether or not a still image is to be displayed continuously as a display image from a time that serves as a reference.

For example, if image information indicative of a still image is supplied from the still image determining section 122, and a still image has been displayed as a display image in three frames immediately preceding a frame to be displayed from now on, in step S46, it is determined that a still image is to be displayed continuously.

If it is determined in step S46 that a still image is to be displayed continuously, in step S47, the changing section 151 decreases the correction value supplied from the limiting section 152 by a value set in advance, thereby changing the correction value. Then, the changing section 151 supplies the changed correction value to the limiting section 152, and thereafter the processing proceeds to step S49.

That is, in the case when a still image is displayed continuously as a display image, since an abrupt change in backlight luminance hardly occurs, there is hardly any fear of the light emission quantity from the backlight 83 becoming insufficient. Accordingly, in the case when a still image is displayed continuously as a display image for a predetermined time period, the changing section 151 decreases the correction value added to the backlight luminance. That is, as a still image is continuously displayed as a display image, the correction value gradually decreases. Thus, it is possible to prevent deterioration in the image quality of the display image which occurs due to insufficient luminance of light from the backlight 83, and also decrease the backlight luminance appropriately to thereby enhance the contrast of the display image.

Also, if it is determined in step S46 that a still image is not to be displayed continuously, that is, a moving image is displayed, and a still image is displayed as a display image during a predetermined time period, the processing proceeds to step S48.

If it is determined in step S46 that a still image is not to be displayed continuously, or if it is determined in step S43 that a predetermined time period has not elapsed, in step S48, the changing section 151 supplies the correction value supplied from the limiting section 152 to the limiting section 152 as it is. When the correction value is supplied from the changing section 151 to the limiting section 152, thereafter, the processing proceeds to step S49.

When the correction value is supplied from the changing section 151 to the limiting section 152 in step S45, step S47, or step S48, in step S49, the limiting section 152 performs a limiting process to limit the correction value supplied from the changing section 151.

That is, for example, if a lower limit value is set as the limiting value in the process in step S42, when the correction value from the changing section 151 is equal to or more than the lower limit value, the limiting section 152 supplies the correction value to the changing section 151 and the addition section 124 as it is. Also, when a lower limit value is set as the limiting value, and the correction value from the changing section 151 is less than the lower limit value, the limiting section 152 supplies the set lower limit value to the changing section 151 and the addition section 124 as the limited correction value.

Here, the reason for limiting the correction value so as not to become smaller than a lower limit value is to prevent a situation in which the correction value becomes too small and, as a result, the backlight luminance becomes unnecessarily small. In this way, by decreasing the correction value appropriately when a still image is displayed continuously, the contrast of the display image can be enhanced.

On the other hand, for example, if an upper limit value is set as the limiting value in the process in step S42, when the correction value from the changing section 151 is equal to or less than the upper limit value, the limiting section 152 supplies the correction value to the changing section 151 and the addition section 124 as it is. Also, when an upper limit value is set as the limiting value, and the correction value from the changing section 151 is larger than the upper limit value, the limiting section 152 supplies the set upper limit value to the changing section 151 and the addition section 124 as the limited correction value.

Here, the reason for limiting the correction value so as not to become larger than an upper limit value is to prevent a situation in which the correction value becomes too large, and the backlight luminance becomes unnecessarily large. In this way, by increasing the correction value appropriately when a moving image is displayed continuously, it is possible to prevent deterioration in the image quality of the display image which occurs due to insufficient light quantity of light from the backlight 83, and also prevent a situation in which the backlight luminance becomes too large, and the display image becomes too bright.

In step S50, the addition section 124 adds the correction value supplied from the limiting section 152 to the backlight luminance supplied from the backlight luminance calculating section 121, thereby correcting the backlight luminance. Then, the addition section 124 supplies the corrected backlight luminance to the backlight control section 82 and the incidence luminance calculating section 125, and the backlight luminance correcting process ends. The processing proceeds to step S13 in FIG. 5.

In this way, in the case when a moving image or a still image is displayed continuously as a display image for a predetermined time period, the display control section 81 changes the correction value every time the predetermined time period elapses.

In this way, by appropriately changing the correction value added to the backlight luminance every time a predetermined time period elapses, it is possible to enhance the contrast of the display image, and also prevent deterioration in the image quality of the display image which occurs due to insufficient light quantity (luminance) of light from the backlight 83.

For example, to prevent insufficiency of the light quantity of light from the backlight, it is also possible to add a correction value that is always constant to the backlight luminance. However, in such a case, the backlight luminance may become too large depending on the display image, resulting in a decrease in the contrast of the display image.

In contrast, in the display apparatus 61, in the case when a still image, which is relatively not prone to insufficient light quantity of light from the backlight 83, is displayed continuously as a display image, the correction value is decreased with time, thereby making it possible to prevent deterioration in the image quality of the display image while enhancing the contrast. Also, in the case when a still image is displayed as a display image, by setting a lower limit value of the correction value as a limiting value, it is possible to prevent the backlight luminance from becoming too small. As a result, deterioration in the image quality of the display image due to insufficient light quantity is prevented.

Further, in the case when a moving image, which is prone to insufficient light quantity of light from the backlight 83, is displayed continuously as a display image, the correction value is increased with time, thereby making it possible to prevent deterioration in the image quality of the display image. Also, in the case when a moving image is displayed as a display image, by setting an upper limit value of the correction value as a limiting value, it is possible to prevent the backlight luminance from becoming too large. As a result, deterioration in the contrast of the display image is suppressed.

It should be noted that in the foregoing, it has been described that the changing section 151 changes the correction value every time a predetermined time period elapses. However, the correction value may be updated whenever necessary, and either the updated correction value or the last outputted correction value may be selected and outputted.

Figure 7:
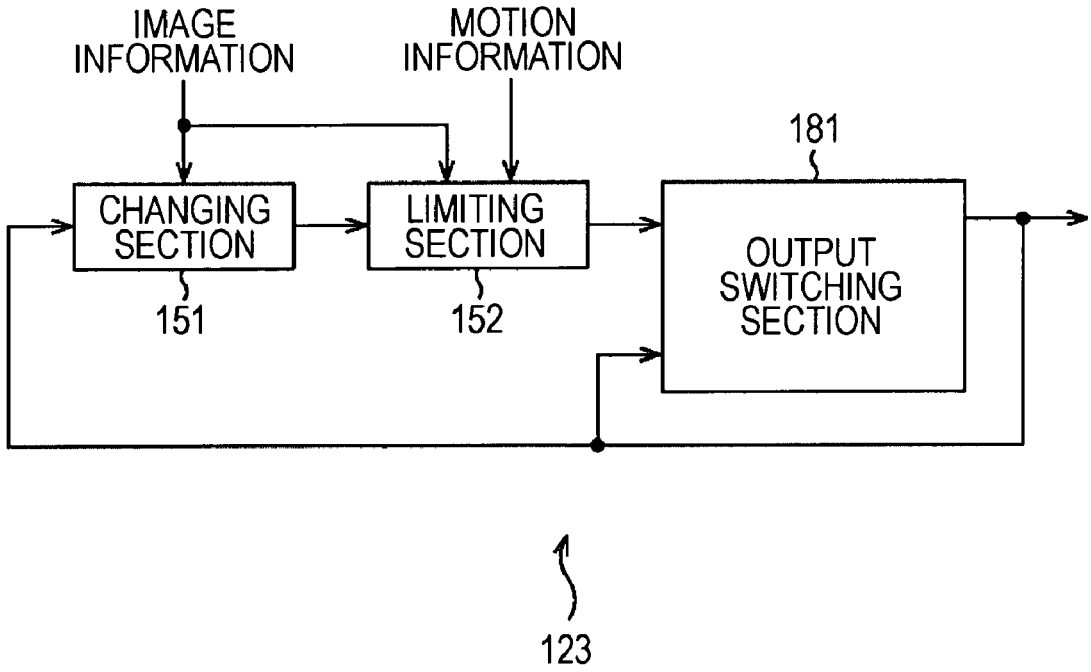
FIG. 7 is a diagram showing another configuration example of a correction value calculating section.

In such a case, for example, the correction value calculating section 123 is configured as shown in FIG. 7. It should be noted that in FIG. 7, portions corresponding to those in the case in FIG. 4 are denoted by the same reference numerals, and description thereof is omitted as appropriate. That is, in the correction value calculating section 123 shown in FIG. 7, an output switching section 181 is further provided to the correction value calculating section 123 in FIG. 4.

The correction value outputted from the output switching section 181 last time as the final correction value, and the changed correction value outputted from the limiting section 152 are supplied to the output switching section 181. The output switching section 181 selects and outputs one of the two supplied correction values. That is, one of the changed correction value for a frame to be displayed from now on, and the final correction value for a frame that temporally immediately precedes the frame is outputted as the final correction value for the frame to be displayed from now on.

Figure 5:
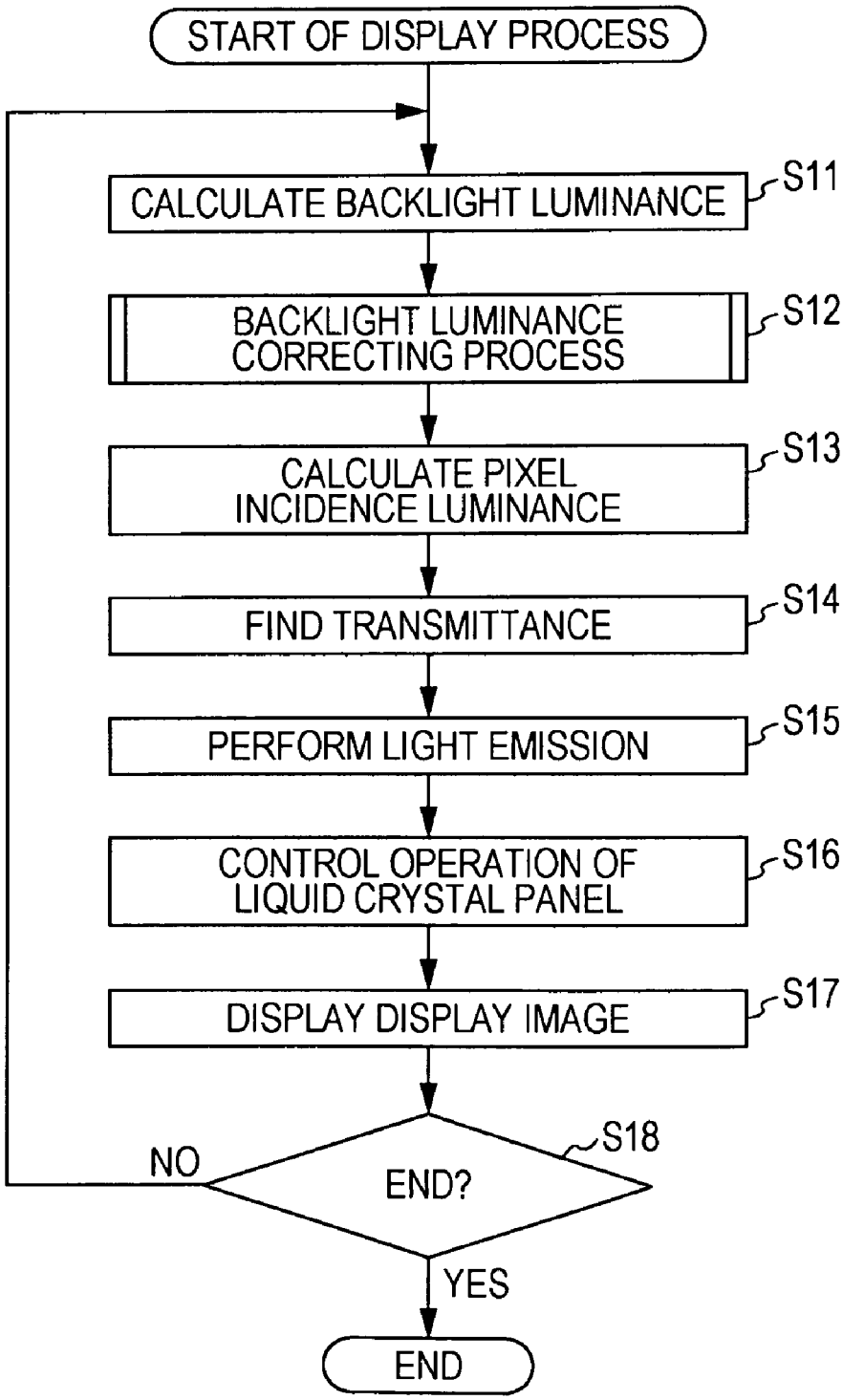
FIG. 5 is a flowchart illustrating a display process.
Figure 6:
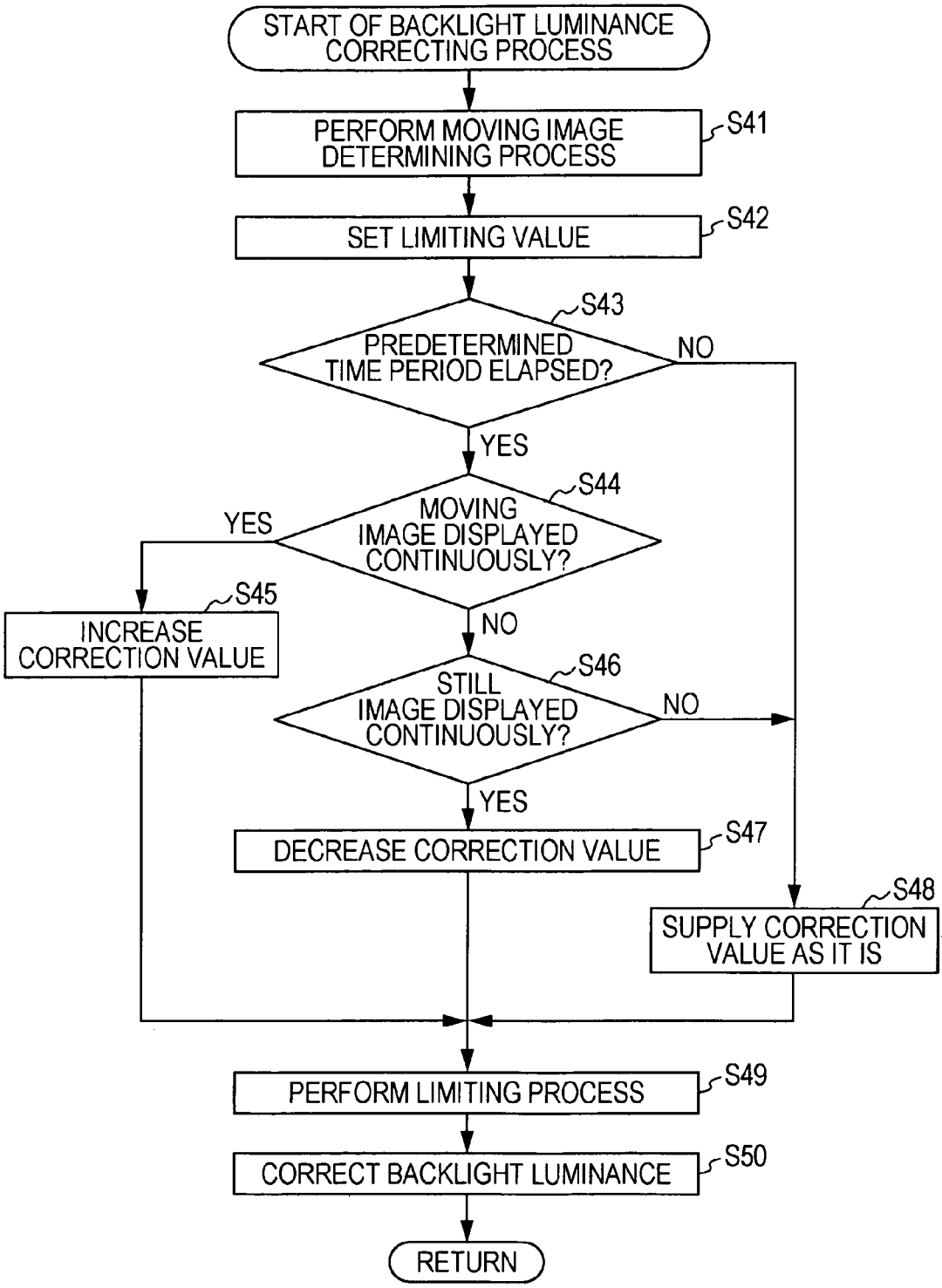
FIG. 6 is a flowchart illustrating a backlight luminance correcting process.

In the case where the correction value calculating section 123 is configured as shown in FIG. 7 as well, the display process described with reference to FIG. 5 is performed, and the display image is displayed.

Next, referring to the flowchart in FIG. 8, a description will be given of a backlight luminance correcting process corresponding to the process in step S12 in FIG. 5, in the case where the correction value calculating section 123 is configured as shown in FIG. 7. It should be noted that since the processes in step S81 and step S82 are the same as the processes in step S41 and step S42 in FIG. 6, description thereof is omitted.

In step S83, on the basis of image information supplied from the moving image determining section 122, the changing section 151 determines whether or not to display a moving image as a display image, that is, whether or not the display image to be displayed from now on is a moving image.

If it is determined in step S83 to display a moving image, in step S84, the changing section 151 increases the correction value supplied from the output switching section 181 by a value set in advance, thereby changing the correction value. Then, the changing section 151 supplies the changed correction value to the limiting section 152, and thereafter the processing proceeds to step S86.

In contrast, if it is determined in step S83 not to display a moving image, that is, if a still image is displayed as a display image, in step S85, the changing section 151 decreases the correction value supplied from the output switching section 181 by a value set in advance, thereby changing the correction value. Then, the changing section 151 supplies the changed correction value to the limiting section 152, and thereafter the processing proceeds to step S86.

When the correction value is changed in step S84 or step S85, in step S86, the control section 152 performs a limiting process to limit the correction value supplied from the changing section 151. It should be noted that since the limiting process performed in step S86 is the same process as the limiting process performed in step S49 in FIG. 6, detailed description thereof is omitted.

When the limiting process is performed by the limiting section 152, the correction value obtained as a result is supplied from the limiting section 152 to the output switching section 181.

In step S87, the output switching section 181 determines whether or not a predetermined time period that is set in advance has elapsed since a time that serves as a reference.

The output switching section 181 switches outputs of a correction value so that the correction value is changed at a predetermined time interval that is set in advance, in order to suppress an abrupt change in backlight luminance. For example, the output switching section 181 counts the number of times display of a display image displayed on the liquid crystal panel 85 has switched, that is, the number of frames of the display image that is displayed, and switches outputs of a correction value so that the correction value supplied from the limiting section 152 is outputted every three frames as a predetermined time interval.

In such a case, the output switching section 181 holds a counter indicating the number of frames of a display image that is displayed, and when display of the display image is started, increments the value of the counter every time the display image is displayed. Then, when three frames' worth of display image is displayed, and the value of the counter becomes "3", the output switching section 181 determines that a predetermined time period that is set in advance has elapsed, and resets the value of the counter to "0" and counts the number of frames again.

If it is determined in step S87 that a predetermined time period has elapsed, that is, if the timing for updating the correction value has been reached, the processing proceeds to step S88.

In step S88, the output switching section 181 outputs the changed correction value, that is, the correction value supplied from the limiting section 152, as a correction value for the backlight luminance of a display image to be displayed from now on. The correction value outputted from the output switching section 181 is supplied to the output switching section 181, the changing section 151, and the addition section 124, and thereafter, the processing proceeds to step S90.

In contrast, if it is determined in step S87 that a predetermined time has not elapsed, that is, if the timing for updating the correction value has not been reached, the processing proceeds to step S89.

In step S89, the output switching section 181 outputs the same correction value as the correction value outputted last time, that is, the correction value outputted from the output switching section 181 and supplied to the output switching section 181 itself, as a correction value for the backlight luminance of a display image to be displayed from now on. The correction value outputted from the output switching section 181 is supplied to the output switching section 181, the changing section 151, and the addition section 124, and thereafter, the processing proceeds to step S90.

When the correction value is outputted in step S88 or step S89, the addition section 124 adds the correction value supplied from the output switching section 181 to the backlight luminance supplied from the backlight luminance calculating section 121, thereby correcting the backlight luminance. Then, the addition section 124 supplies the corrected backlight luminance to the backlight control section 82 and the incidence luminance calculating section 125, and the backlight luminance correcting process ends. The processing proceeds to step S13 in FIG. 5.

In this way, the display control section 81 changes the correction value at a predetermined time interval, in accordance with whether the display image is a moving image or is a still image.

In this way, by appropriately changing the correction value added to the backlight luminance at a predetermined time interval in accordance with whether the display image is a moving image or is a still image, it is possible to enhance the contrast of the display image, and also prevent deterioration in the image quality of the display image which occurs due to insufficient light quantity (luminance) of light from the backlight 83.

It should be noted that while the correction value changed in the changing section 151 is limited in the limiting section 152, there are cases in which when an upper limit value as a limiting value is changed from upper limit value UL2 to upper limit value UL1 that is smaller than upper limit value UL2, the changed correction value is limited by upper limit value UL1, and abruptly becomes small. When the correction value abruptly becomes small in this way, the backlight luminance also becomes abruptly small, and thus there is a fear that the image quality of the display image may deteriorate due to the abrupt change in backlight luminance.

Accordingly, if the correction value outputted last time is larger than the upper limit value set as a limiting value this time, that is, if the upper limit value as a limiting value is changed to a smaller upper limit value, the limiting value may be set anew so as to prevent an abrupt decrease in correction value.

Figure 9:
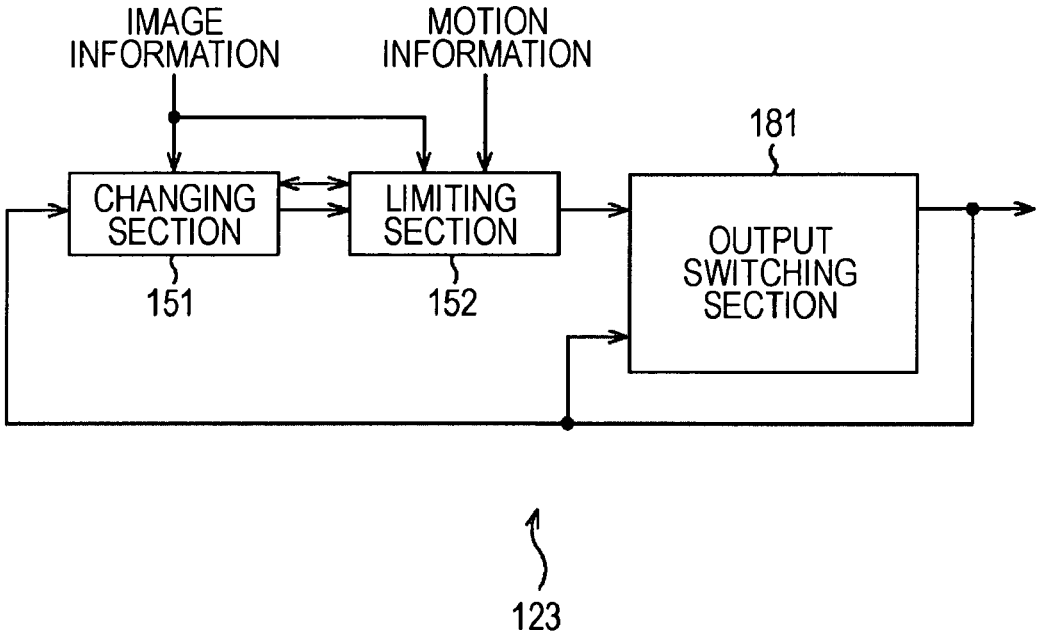
FIG. 9 is a diagram showing another configuration example of a backlight luminance calculating section.

In such a case, in the correction value calculating section 123, for example, as shown in FIG. 9, the control section 152 notifies the changing section 151 of the limiting value that has been set, and if the correction value from the output switching section 181 is larger than the upper limit value as a limiting value which is notified from the limiting section 152, the changing section 151 requests the limiting section 152 to set the limiting value again.

Then, the limiting section 152 sets the limiting value anew in accordance with the request from the changing section 151. That is, the limiting section 152 sets not an upper limit value but a lower limit value as the limiting value. Thus, an abrupt decrease in correction value is prevented. As a result, it is possible to prevent deterioration in the image quality of the display image which occurs due to an abrupt decrease in backlight luminance.

It should be noted that portions of the correction value calculating section 123 shown in FIG. 9 corresponding to those in the case in FIG. 7 are denoted by the same reference numerals, and description thereof is omitted as appropriate. That is, the correction value calculating section 123 in FIG. 9 differs from the correction value calculating section 123 in FIG. 7 in that the changing section 151 and the limiting section 152 mutually give and receive information.

In the case where the correction value calculating section 123 is configured as shown in FIG. 9 as well, the display process described with reference to FIG. 5 is performed, and the display image is displayed.

Figure 10:
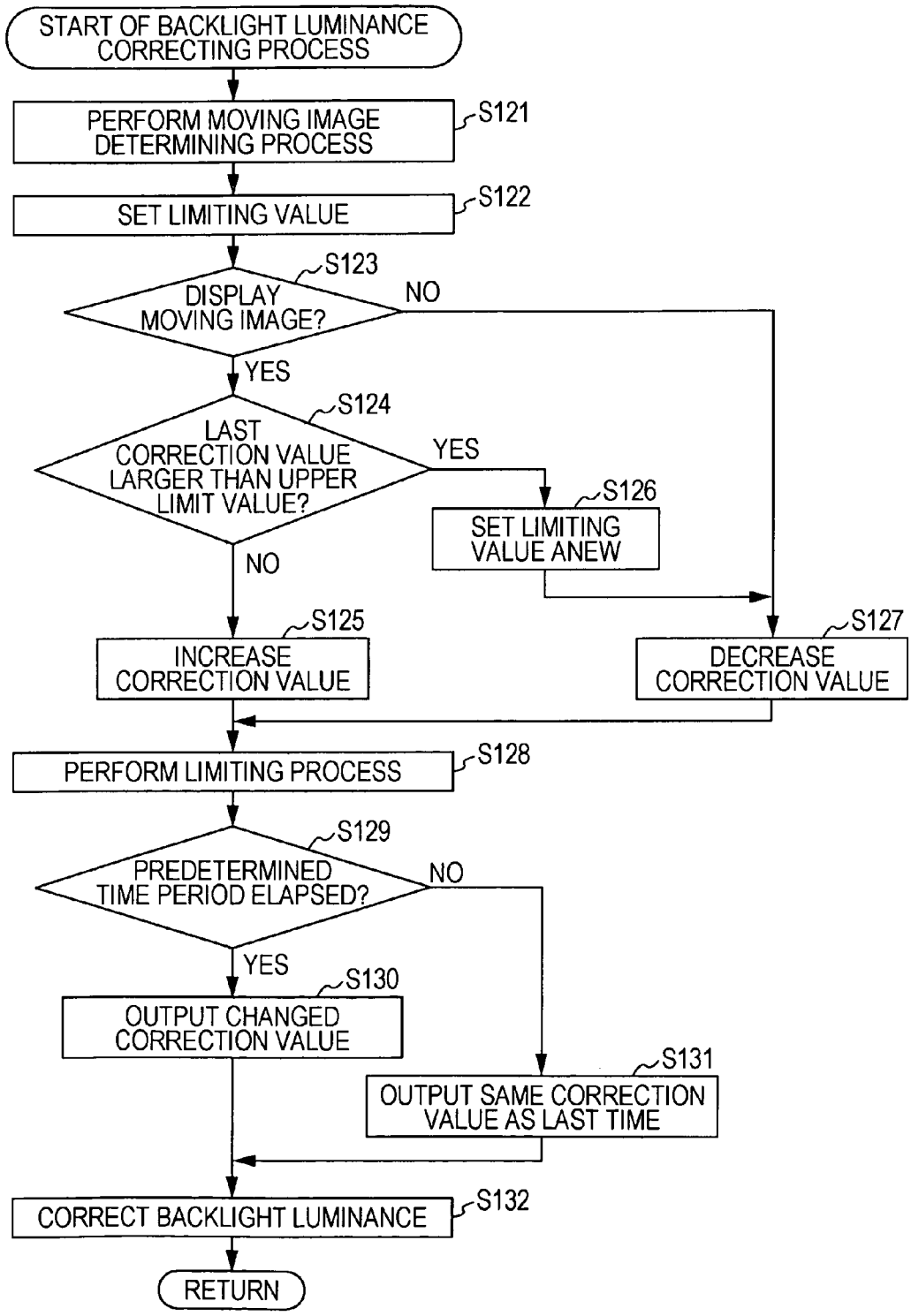
FIG. 10 is a flowchart illustrating a backlight luminance correcting process.

Next, referring to the flowchart in FIG. 10, a description will be given of a backlight luminance correcting process corresponding to the process in step S12 in FIG. 5, in the case where the correction value calculating section 123 is configured as shown in FIG. 9.

Figure 8:
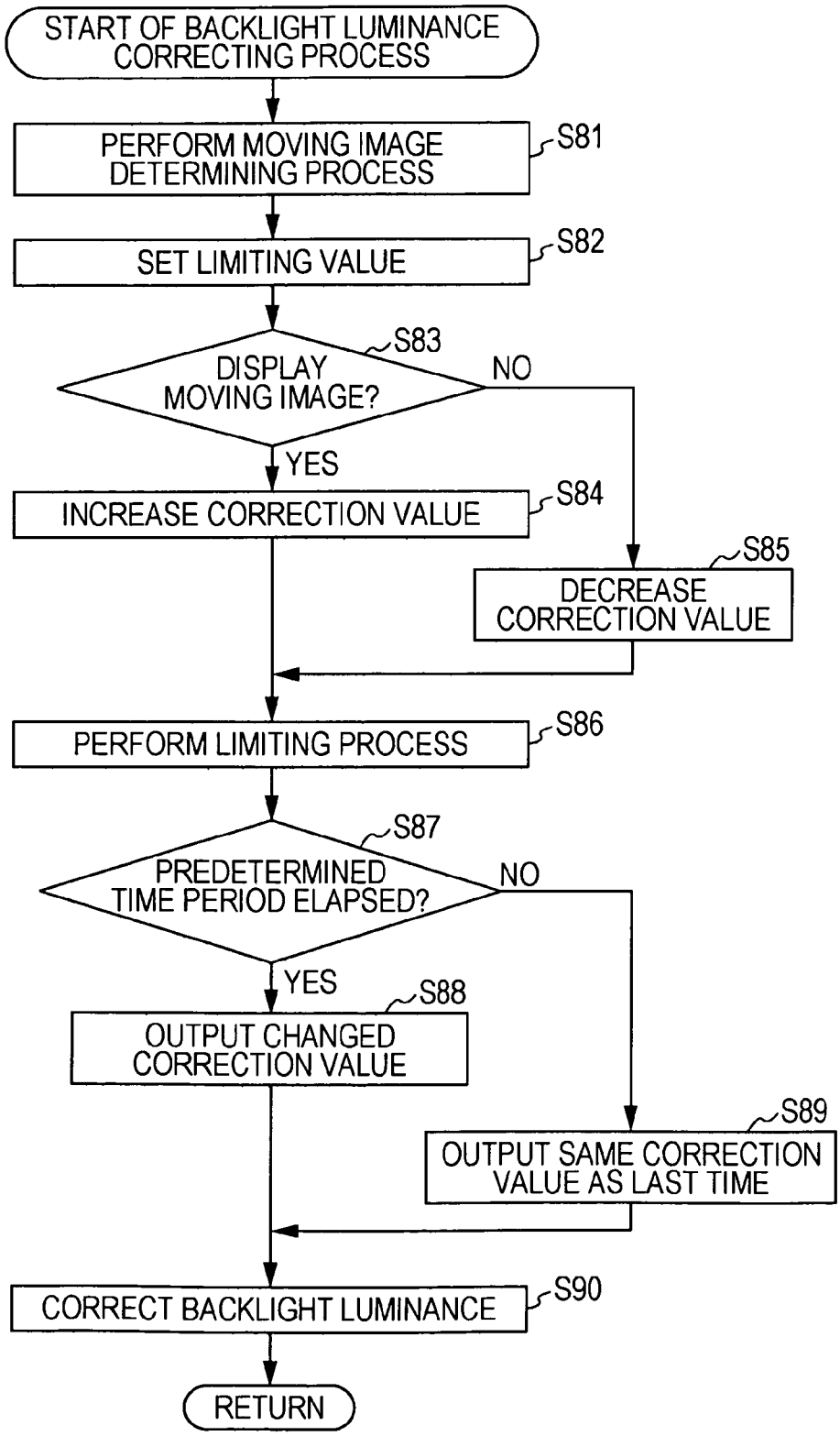
FIG. 8 is a flowchart illustrating a backlight luminance correcting process.

It should be noted that since the processes in step S121 and step S122 are the same as the processes in step S81 and step S82 in FIG. 8, description thereof is omitted. However, when a limiting value is set by the limiting section 152 in step S122, the set limiting value is supplied from the limiting section 152 to the changing section 151.

In step S123, on the basis of image information supplied from the moving image determining section 122, the changing section 151 determines whether or not to display a moving image as a display image, that is, whether or not the display image to be displayed from now on is a moving image.

If it is determined in step S123 to display a moving image, in step S124, the changing section 151 determines whether or not the last correction value, that is, the correction value supplied from the output switching section 181 is larger than an upper limit value as a limiting value which is supplied from the limiting section 152. That is, in the case when a moving image is displayed as a display image, an upper limit value according to the motion amount indicated by motion information is set as the limiting value. Thus, the last correction value and the upper limit value that has been set are compared with each other.

If it is determined in step S124 that the last correction value is not larger than the upper limit value, in step S125, the changing section 151 increases the correction value supplied from the output switching section 181 by a value set in advance, thereby changing the correction value. Then, the changing section 151 supplies the changed correction value to the limiting section 152, and thereafter the processing proceeds to step S128.

That is, if the last correction value is equal to or less than the newly set upper limit value, since the changed correction value does not decrease abruptly as it is limited by the upper limit value, the correction value is changed so that the last correction value increases by a value that is set in advance.

In contrast, if it is determined in step S124 that the last correction value is larger than the upper limit value, since there is a fear that the changed correction value decreases abruptly as it is limited by the upper limit value, the changing section 151 requests the limiting section 152 to set the limiting value again, and the processing proceeds to step S126.

In step S126, the limiting section 152 sets the limiting value anew in accordance with the request from the changing section 151. That is, the limiting section 152 cancels the setting of an upper limit value as a limiting value, and newly sets a lower limit value that is set in advance, as a limiting value. Thus, it is possible to prevent a situation in which the changed correction value is limited by an upper limit value that has been set up to this time, and decreases abruptly.

When the limiting value is set anew in step S126, thereafter, the processing proceeds to step S127.

Also, if it is determined in step S123 not to display a moving image, that is, if a still image is displayed as a display image, the processing proceeds to step S127.

When the limiting value is set anew in step S126, or when it is determined in step S123 not to display a moving image, in step S127, the changing section 151 decreases the correction value supplied from the output switching section 181 by a value set in advance, thereby changing the correction value. Then, the changing section 151 supplies the changed correction value to the limiting section 152, and thereafter the processing proceeds to step S128.

When the correction value is changed in step S125 or step S127, thereafter, the processes in step S128 to step S132 are performed. Since these processes are the same as the processes in step S86 to step S90 in FIG. 8, description thereof is omitted.

When the backlight luminance is corrected in step S132, the corrected backlight luminance is supplied from the addition section 124 to the backlight control section 82 and the incidence luminance calculating section 125, and the backlight luminance correcting process ends. The processing proceeds to step S13 in FIG. 5.

In this way, in the case when a moving image is displayed as a display image, if the last correction value is larger than an upper limit value as a limiting value that has been set, the display control section 81 sets the limiting value anew to prevent an abrupt decrease in correction value, and decreases the correction value. Thus, it is possible to prevent deterioration in the image quality of the display image which occurs due to an abrupt decrease in backlight luminance.

The series of processes described above can be either executed by hardware or executed by software. If the series of processes is to be executed by software, a program constituting the software is installed into a computer embedded in dedicated hardware, or into, for example, a general purpose personal computer that can execute various functions when installed with various programs, from a program-recording medium.

Figure 11:
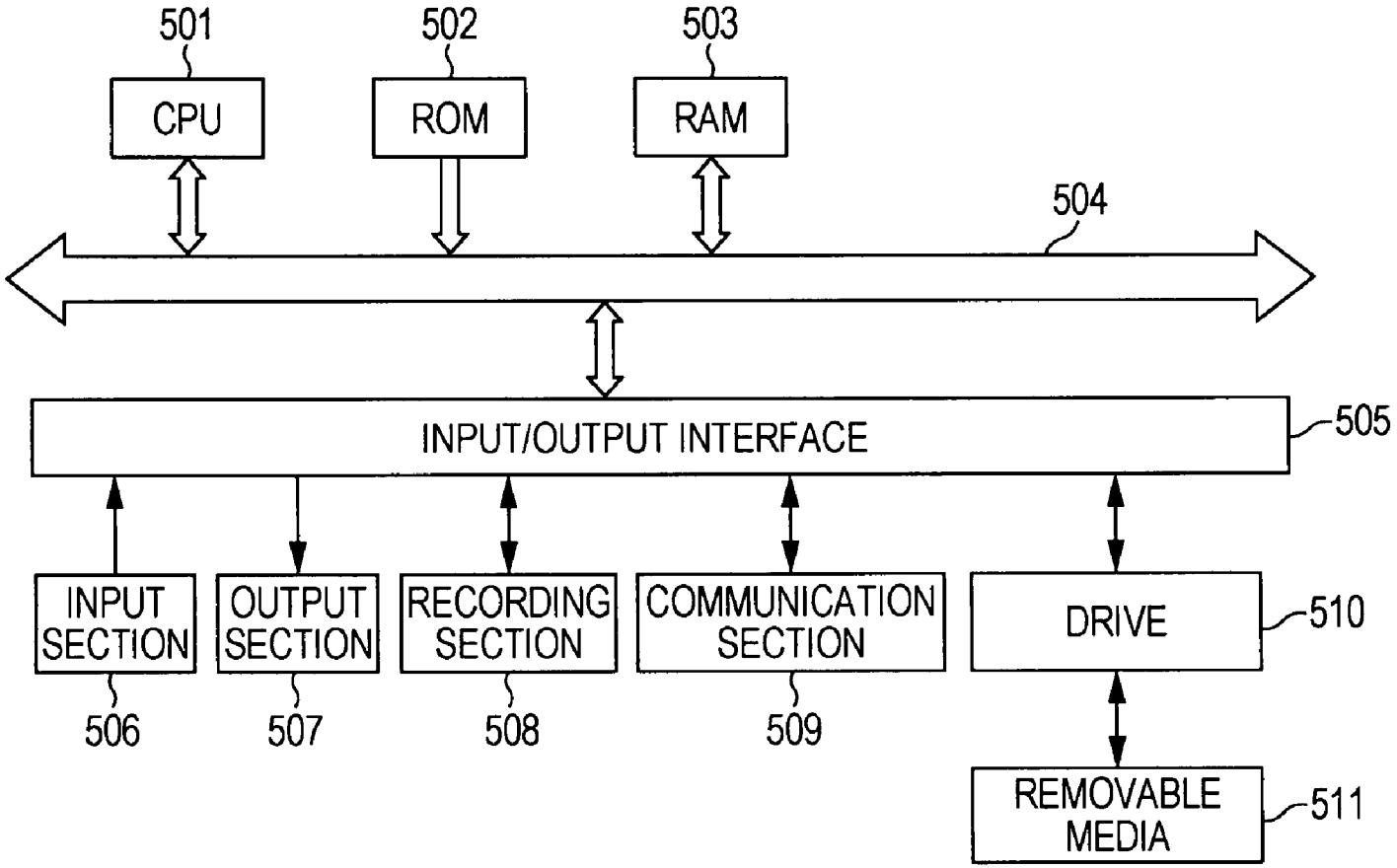
FIG. 11 is a diagram showing a configuration example of a computer.

FIG. 11 is a block diagram showing a hardware configuration example of a computer that executes the above-described series of processes by a program.

In the computer, a CPU (Central Processing Unit) 501, a ROM (Read Only Memory) 502, and a RAM (Random Access Memory) 503 are connected to each other by a bus 504.

The bus 504 is further connected with an input/output interface 505. The input/output interface 505 is connected with an input section 506 made of a keyboard, a mouse, a microphone, or the like, an output section 507 made of a display, a speaker, or the like, a recording section 508 made of a hard disk, a non-volatile memory, or the like, a communication section 509 made of a network interface or the like, and a drive 510 that drives removal media 511 such as a magnetic disk, an optical disc, a magneto-optical disc, or a semiconductor memory.

In the computer configured as above, for example, the CPU 501 executes a program recorded in the recording section 508 by loading the program into the RAM 503 via the input/output interface 505 and the bus 504, thereby performing the above-described series of processes.

The program executed by the computer (CPU 501) is provided by, for example, being recorded on the removable media 511, which is packaged media made of a magnetic disk (including a flexible disk), an optical disc (such as a CD-ROM (Compact Disc-Read Only Memory) or a DVD (Digital Versatile Disc)), a magneto-optical disc, a semiconductor memory, or the like, or via a wired or wireless transmission medium, such as a local area network, the Internet, or digital satellite broadcast.

Then, the program can be installed into the recording section 508 via the input/output interface 505, by mounting the removable media 511 in the drive 510. Also, the program can be received by the communication section 509 via a wired or wireless transmission medium, and installed into the recording medium 508. Alternatively, the program can be installed into the ROM 502 or the recording section 508 in advance.

The program executed by the computer may be a program in which processes are performed in time series in the order described in this specification, or may be a program in which processes are performed in parallel or at necessary timing, such as when invoked.

It should be noted that an embodiment of the present invention is not limited to the above-described embodiment, but various modifications are possible without departing from the scope of the present invention.

EXPLANATION OF REFERENCE NUMERALS

61 display apparatus, 81-1 to 81-4, 81 display control section, 82-1 to 82-4, 82 backlight control section, 83-1 to 83-4, 83 backlight, 84 liquid crystal panel control section, 85 liquid crystal panel, 121 backlight luminance calculating section, 122 moving image determining section, 123 correction value calculating section, 124 addition section, 125 incidence luminance calculating section, 126 division section, 151 changing section, 152 limiting section, 181 output switching section

The invention claimed is:

1. A display control apparatus comprising:

luminance calculating means for calculating a backlight luminance on the basis of an image signal of a display image, the backlight luminance indicating a luminance of light which is made incident on a display panel that displays the display image by transmitting light, and which is radiated by a backlight;

correction value changing means for increasing a correction value for correcting the backlight luminance of a previous display image, which is the display image displayed temporally before a not-yet-displayed image that is the display image to be displayed from now on, to obtain the correction value for the not-yet-displayed image when the not-yet-displayed image is a moving image, and decreasing the correction value for the previous display image to obtain the correction value for the not-yet-displayed image when the not-yet-displayed image is a still image;

correcting means for correcting the backlight luminance by adding the correction value changed by the correction value changing means, to the backlight luminance of the not-yet-displayed image;

motion detecting means for detecting motion from the not-yet-displayed image on the basis of the image signal; and limiting means for setting an upper limit value of the correction value for the not-yet-displayed image in accordance with a motion amount of the motion detected from the not-yet-displayed image, when the not-yet-displayed image is a moving image, and setting the upper limit value as the correction value for the not-yet-displayed image when the correction value is larger than the upper limit value, in which at least one of (i) the luminance calculating means, (ii) the correction value changing means, (iii) the correcting means, (iv) the motion detecting means, and (v) the limiting means, is configured as hardware.

2. The display control apparatus according to claim 1, wherein:

the limiting means sets a lower limit value of the correction value for the not-yet-displayed image when the not-yet-displayed image is a still image, and sets the lower limit value as the correction value for the not-yet-displayed image when the correction value is smaller than the lower limit value.

3. The display control apparatus according to claim 2, wherein:

the limiting means cancels setting of the upper limit value and sets the lower limit value, when the display image is a moving image, and the correction value for the previous display image is larger than the upper limit value for the not-yet-displayed image; and the correction value changing means decreases the correction value for the previous display image to obtain the correction value for the not-yet-displayed image.

4. A display control method for a display control apparatus including luminance calculating means for calculating a backlight luminance on the basis of an image signal of a display image, the backlight luminance indicating a luminance of light which is made incident on a display panel that displays the display image by transmitting light, and which is radiated by a backlight, correction value changing means for increasing a correction value for correcting the backlight luminance of a previous display image, which is the display image displayed temporally before a not-yet-displayed image that is the display image to be displayed from now on, to obtain the correction value for the not-yet-displayed image when the not-yet-displayed image is a moving image, and decreasing the correction value for the previous display image to obtain the correction value for the not-yet-displayed image when the not-yet-displayed image is a still image, correcting means for correcting the backlight luminance by adding the correction value changed by the correction value changing means, to the backlight luminance of the not-yet-displayed image, motion detecting means for detecting motion from the not-yet-displayed image on the basis of the image signal, and limiting means for setting an upper limit value of the correction value for the not-yet-displayed image in accordance with a motion amount of the motion detected from the not-yet-displayed image, when the not-yet-displayed image is a moving image, and setting the upper limit value as the correction value for the not-yet-displayed image when the correction value is larger than the upper limit value, the display control method comprising the steps of:

the luminance calculating means calculating the backlight luminance of the not-yet-displayed image on the basis of the image signal of the not-yet-displayed image;

the correction value changing means increasing the correction value for the previous display image to obtain the correction value for the not-yet-displayed image when the not-yet-displayed image is a moving image, and decreasing the correction value for the previous display image to obtain the correction value for the not-yet-displayed image when the not-yet-displayed image is a still image;

the motion detecting means detecting motion from the not-yet-displayed image on the basis of the image signal;

the limiting means setting the upper limit value of the correction value for the not-yet-displayed image in accordance with a motion amount of the motion detected from the not-yet-displayed image, when the not-yet-displayed image is a moving image, and setting the upper limit value as the correction value for the not-yet-displayed image when the correction value is larger than the upper limit value; and the correcting means correcting the backlight luminance by adding the correction value that has been changed, to the backlight luminance of the not-yet-displayed image, in which at least one of (i) the luminance calculating means, (ii) the correction value changing means, (iii) the correcting means, (iv) the motion detecting means, and (v) the limiting means, is configured as hardware.

5. A non-transitory recording medium having stored thereon a program for causing a computer to execute processing including the steps of:

calculating a backlight luminance on the basis of an image signal of a display image, the backlight luminance indicating a luminance of light which is made incident on a display panel that displays the display image by transmitting light, and which is radiated by a backlight;

increasing a correction value for correcting the backlight luminance of a previous display image, which is the display image displayed temporally before a not-yet-displayed image that is the display image to be displayed from now on, to obtain the correction value for the not-yet-displayed image when the not-yet-displayed image is a moving image, and decreasing the correction value for the previous display image to obtain the correction value for the not-yet-displayed image when the not-yet-displayed image is a still image;

detecting motion from the not-yet-displayed image on the basis of the image signal;

setting an upper limit value of the correction value for the not-yet-displayed image in accordance with a motion amount of the motion detected from the not-yet-displayed image, when the not-yet-displayed image is a moving image, and setting the upper limit value as the correction value for the not-yet-displayed image when the correction value is larger than the upper limit value; and correcting the backlight luminance by adding the correction value that has been changed, to the backlight luminance of the not-yet-displayed image.

* * * * *